US008276557B2

(12) United States Patent
Inata

(10) Patent No.: US 8,276,557 B2
(45) Date of Patent: Oct. 2, 2012

(54) VARIABLE VALVE ACTIVATION SYSTEM FOR INTERNAL COMBUSTION ENGINE

(75) Inventor: Hiroki Inata, Shizuoka-ken (JP)

(73) Assignee: Suzuki Motor Corporation, Hamamatsu-shi (JP)

( * ) Notice: Subject to any disclaimer, the term of this patent is extended or adjusted under 35 U.S.C. 154(b) by 320 days.

(21) Appl. No.: 12/592,928

(22) Filed: Dec. 4, 2009

(65) Prior Publication Data

US 2010/0206254 A1 Aug. 19, 2010

(30) Foreign Application Priority Data

Feb. 13, 2009 (JP) ..... 2009-031332

(51) Int. Cl.
*F01L 1/34* (2006.01)

(52) U.S. Cl. ..... 123/90.16

(58) Field of Classification Search ..... 123/90.16, 123/90.15

See application file for complete search history.

(56) References Cited

U.S. PATENT DOCUMENTS

| | | | | |
|---|---|---|---|---|
| 5,937,809 | A * | 8/1999 | Pierik et al. | 123/90.16 |
| 6,382,151 | B2 * | 5/2002 | Pierik | 123/90.16 |
| 6,439,177 | B2 * | 8/2002 | Pierik | 123/90.16 |
| 6,736,095 | B2 * | 5/2004 | Pierik | 123/90.16 |
| 7,111,600 | B2 * | 9/2006 | Naumann | 123/90.39 |
| 7,467,609 | B2 * | 12/2008 | Naumann | 123/90.16 |
| 7,591,238 | B2 * | 9/2009 | Tateno et al. | 123/90.16 |
| 7,669,564 | B2 * | 3/2010 | Tochiki et al. | 123/90.16 |
| 7,789,053 | B2 * | 9/2010 | Kong et al. | 123/90.16 |
| 8,011,336 | B2 * | 9/2011 | Takemoto et al. | 123/90.16 |
| 2005/0103292 | A1 * | 5/2005 | Naumann | 123/90.16 |
| 2008/0245325 | A1 * | 10/2008 | Eisenbeis | 123/90.16 |
| 2010/0059005 | A1 * | 3/2010 | Stone et al. | 123/90.16 |

FOREIGN PATENT DOCUMENTS

JP 2000-038910 2/2000

* cited by examiner

*Primary Examiner* — Thomas Denion
*Assistant Examiner* — Daniel Bernstein
(74) *Attorney, Agent, or Firm* — Flynn, Thiel, Boutell & Tanis, P.C.

(57) ABSTRACT

Variable valve activation system for internal combustion engines includes a first arm, a link mechanism, a swing cam, and a variable mechanism, which continuously varies lift amount of an engine valve. The link mechanism includes a second arm rotatably linked with the first arm for transmitting the movement of the first arm to the swing cam. The variable mechanism includes a first gear provided concentrically with a swing shaft of the first arm and a second gear provided to the second arm concentrically with the link pin so as to engage with the first gear. The rotation of the first gear causes the second arm to swing and varies the swing position of the swing cam with respect to the engine valve, and in a state the first gear is in a halt or stopped position, the first arm causes the second arm to swing in a swing direction of the first arm.

2 Claims, 6 Drawing Sheets

LOW-LIFT (BEFORE LIFTING ENGINE VALVE)

LOW-LIFT (DURING LIFTING ENGINE VALVE)

BEFORE LIFTING DURING LIFTING $\alpha 1 \longrightarrow \alpha 2$ $\beta 1 \longrightarrow \beta 2$

HIGH-LIFT (BEFORE LIFTING ENGINE VALVE)

HIGH-LIFT (DURING LIFTING ENGINE VALVE)

BEFORE LIFTING DURING LIFTING $\alpha 3 \longrightarrow \alpha 4$ $\beta 3 \longrightarrow \beta 4$

VARIABLE VALVE ACTIVATION SYSTEM FOR INTERNAL COMBUSTION ENGINE

FIELD OF THE INVENTION

The present invention relates to a variable valve activation system for internal combustion engines, and particularly to a variable valve activation system for internal combustion engines capable of downsizing of the variable valve activation system and increasing mounting performance thereof by providing a compact arrangement on an internal combustion engine.

BACKGROUND OF THE INVENTION

In order to increase the combustion stability during low speed operation under a small load and to ensure the output during high speed operation under a large load, some internal combustion engines mounted on a vehicle or the like are provided with a variable valve activation system. The variable valve activation system changes lift timing and lift amount of an engine valve, like an intake or exhaust valve. The engine valve is driven to open/close by a drive cam provided to a camshaft of a valve train corresponding to the operation status of the internal combustion engine.

JP 2000-38910A teaches a variable valve activation system for internal combustion engines, which comprises a first arm, which is driven to swing by a drive cam, provided to a camshaft, a swing cam, which is linked with the first arm being interposed by a link mechanism and is driven to swing by the first arm to thereby cause an engine valve to open/close, and a variable mechanism which varies the swing position of the swing cam with respect to the engine valves. In this variable valve activation system, the first arm is provided with a control arm arranged as an eccentric shaft, which is pivoted eccentrically on a swing shaft of the first arm. By the rotation of the eccentric swing shaft, the swing position of the first arm is changed by means of the control arm and the open/close timing of the engine valve and the lift amount are continuously varied.

FIGS. 6(A) and 6(B) illustrate a conventional variable valve activation system 101 for internal combustion engines. The variable valve activation system 101 comprises a first arm 106, which is pivoted on a swing shaft 105 so as to be driven to swing by a drive cam 103 on a camshaft 102 that contacts a roller 104 mounted on the first arm 106. A swing cam 111 is linked with the first arm 106 by a rod 108 of a link mechanism 107 and is pivoted on the camshaft 102 so as to be driven by the first arm 106 to swing to open/close an engine valve 110 being interposed by a tappet 109. A variable mechanism 112, which varies the swing position of the swing cam 111 with respect to the engine valve 110, includes a control arm 113 on which the first arm 106 is eccentrically pivoted on the swing shaft 105 of the first arm 106, so that the swing shaft 105 is arranged as an eccentric shaft.

The variable valve activation system 101 for internal combustion engines is arranged so that, utilizing the rotation of the swing shaft 105 as the eccentric shaft, the swing fulcrum P of the first arm 106 is shifted by the control arm 113 to thereby continuously vary the lift amount of the engine valve 110. Defining the length of the first arm 106 as L1, and the length of the rod 108 as L3, the lift amount of the engine valve 110 results in length L4.

FIGS. 7(A) and 7(B) illustrate another variable valve activation system 201 for internal combustion engines. In FIGS. 7(A) and 7(B), parts in the variable valve activation system 201 having the same function as those in the variable valve activation system 101 shown in FIGS. 6(A) and 6(B) are given with the same second and third reference numerals after numeral "2". In order to increase the lift amount of the engine valve 210, the length of the first arm 206 is elongated to L1+α, and the length of the rod 208 is elongated to L3+β. As a result, the lift amount of the engine valve 210 is increased to L4+γ. The lift amount of the engine valve 210 can be also increased by increasing the lift amount of the drive cam 203.

However, when the length of the first arm 206 and the length of the rod 208 are elongated, the lift amount of the engine valve 210 can be increased just a little. On the other hand, the space that is necessary for allowing the movement of the first arm 206 and the rod 208, increases greatly. As a result, the variable valve activation system is restricted to be mounted on the cylinder head. Also, the lift amount may be increased by increasing the size of the drive cam 203. However, in order to prevent interference between the maximum lift path of the drive cam 203 and the swing shaft 205, since the distance L5 between the camshaft 202 and the swing shaft 205 (refer to FIGS. 7(A) and 7(B)) has to be increased, the downsizing of the variable valve activation system 201 is adversely restricted.

Further, in the link mechanism 107 of the variable valve activation system 101 shown in FIGS. 6(A) and 6(B), for example, in the case where the swing shaft 105 of the first arm 106 is the eccentric shaft, since the lift amount of the engine valve 110 increases, eccentric amount L6 for the control arm 113 has to be increased. As a result, the size of the link structure within a cylinder head increases, resulting in an increase of the restrictions on the head structure (for example, interference between the swing shaft and the drive cam or the like).

Furthermore, for example, in the variable valve activation system 101 shown in FIGS. 6(A) and 6(B), compared to an ordinary rotating cam (for example, drive cam 103), the operating angle of the swing cam 111 as the final cam that acts on the valve lift becomes smaller. Due to the cam profile, there may arise a problem such that lubrication becomes poor (increase of friction and wear), or optimization of the valve lift may be restricted (for example, increase of external diameter of the tappet).

It is an object of the invention to provide a variable valve activation system for internal combustion engines capable of continuously varying lift amount of the engine valve. Particularly, the variable valve activation system is capable of downsizing of the variable valve activation system without reducing lift amount of the engine valve to thereby increase the mounting performance and provide a compact arrangement for the variable activation system as mounted on an internal combustion engine.

SUMMARY OF THE INVENTION

The invention is a variable valve activation system for internal combustion engines, which comprises: a first arm driven to swing by a drive cam provided to a camshaft; a swing cam linked with the first arm being interposed by a link mechanism, driven to swing by the first arm to thereby open/close an engine valve; and a variable mechanism for varying swing position of a swing cam with respect to the engine valve. The variable mechanism continuously varies lift amount of the engine valve, wherein the link mechanism includes a second arm rotatably linked with the first arm by means of a link pin for transmitting the movement of the first arm to the swing cam. The variable mechanism includes a first gear provided concentrically with a swing shaft of the first arm and a second gear provided to the second arm concentrically with the link pin so as to engage with the first gear. The variable valve activation system is arranged so that the rotation of the first gear causes the second arm to swing and vary the swing position of the swing cam with respect to the engine valve. While in a state with the first gear in a halt, the first arm is caused to swing to thereby swing the second arm in a swing direction of the first arm.

The variable valve activation system for internal combustion engines according to the invention has a structure such that the rotation of the first gear is transmitted to the swing cam being interposed by the second arm to vary the swing position of the swing cam to thereby vary the lift amount of the engine valve. Therefore, compared to the conventional structure in which the swing fulcrum of the first arm is shifted by an eccentric shaft to thereby vary the lift amount of the engine valve, the space necessary to shift the parts around the swing fulcrum of the first arm can be reduced.

Also, the variable valve activation system for internal combustion engines according to the invention has a structure such that, in a state that the first gear is held in a halt, the first arm is caused to swing to thereby swing the second arm in a swing direction of the first arm. Therefore, when the lift amount of the engine valve is the same as the conventional variable valve activation system, the drive cam and the first arm can be downsized. Therefore, the variable valve activation system for internal combustion engines of the invention can be downsized; and thus the mounting performance on an internal combustion engine is increased.

Further, the variable valve activation system for internal combustion engines of the invention is capable of changing the lift amount of the engine valve by changing the gear ratio between the first gear and the second gear. Therefore, the mounting performance of the system on an internal combustion engine having a different lift amount for the engine valve is increased.

DETAILED DESCRIPTION OF THE INVENTION

The invention is intended to achieve a variable valve activation system having a variable mechanism including a first gear concentrically provided with a swing shaft of a first arm and a second gear provided to a second arm concentrically with a link pin so as to engage with the first gear to thereby vary the lift amount of the engine valve. Thus the variable valve activation system is downsized and the mounting performance on an internal combustion engine is increased as the volume of the valve activation system with an engine compartment is advantageously minimized.

Embodiments of the invention will be described below with reference to the drawings.

FIG. 1(A) to FIG. 4(B) show an embodiment of the invention.

Figure 1A:
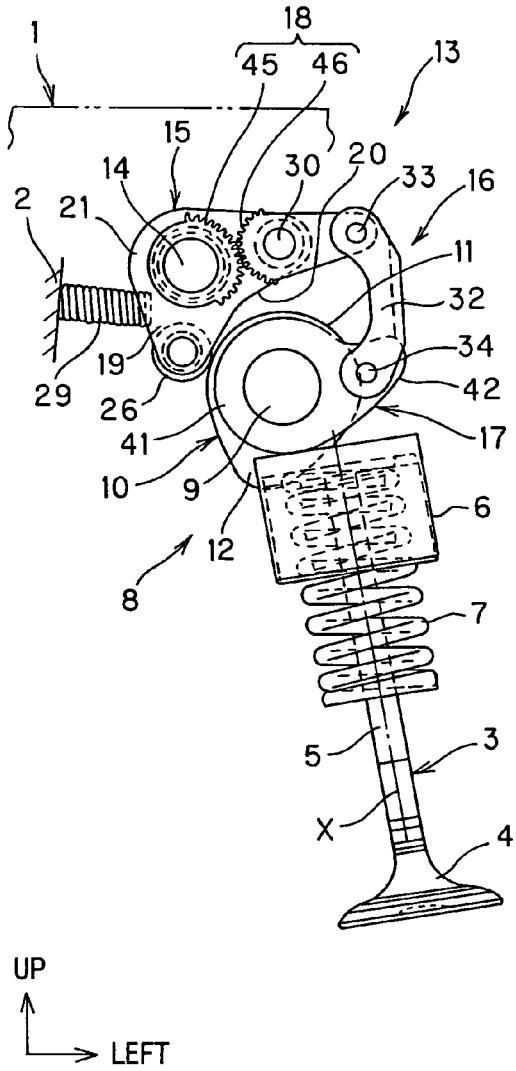
FIG. 1(A) is a front view of a variable valve activation system according to an embodiment of the invention.
Figure 1B:
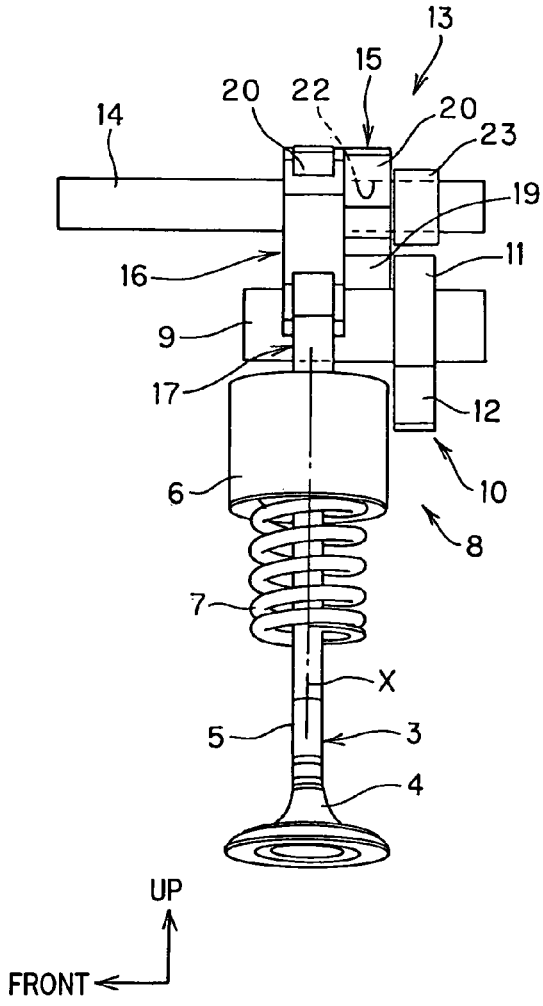
FIG. 1(B) is a side view of the variable valve activation system.
Figure 2:
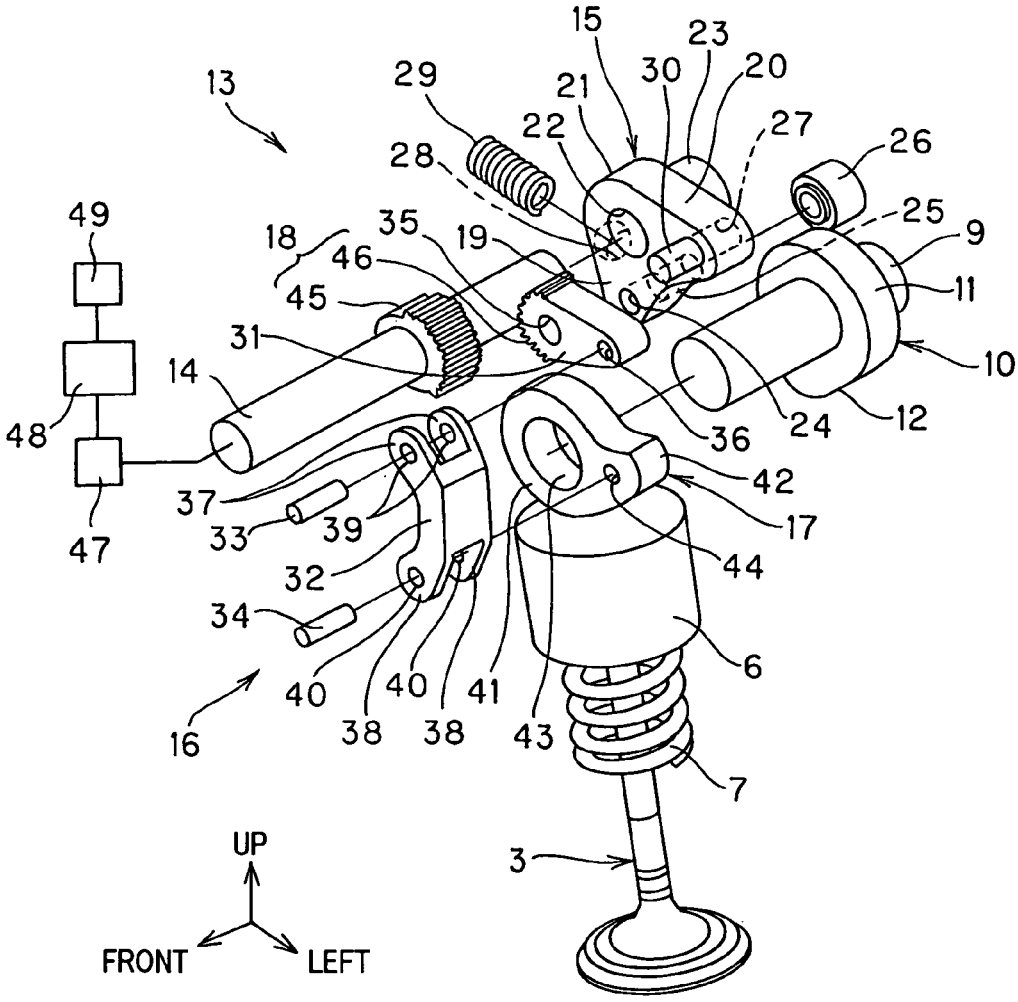
FIG. 2 is an exploded view of the variable valve activation system.

In FIG. 1(A), FIG. 1(B) and FIG. 2, an internal combustion engine 1 and a cylinder head 2 are illustrated. The internal combustion engine 1 is mounted vertically with a crankshaft oriented in a front-rear direction of a vehicle. The cylinder head 2 located in an upper area of the internal combustion engine 1 has an engine valve 3 as an intake or exhaust valve for opening/closing an intake or exhaust port that communicates with a combustion chamber.

The engine valve 3 includes a valve head 4 that is brought into contact with an opening of the port and separated away therefrom, and a valve stem 5 with a front end thereof integrally connected to the valve head 4. The engine valve 3 is disposed with the axis X thereof inclined, from right upper side toward left lower side as viewed from a front side thereof, with respect to the cylinder head 2 to support the valve stem 5 movably in the axis direction closer to/away from the cylinder head 2. The engine valve 3 has a tappet 6 attached to a base end of the valve stem 5 and a valve spring 7 disposed between the tappet 6 and the cylinder head 2 to bias the valve in an opening direction thereof.

The internal combustion engine 1 is provided with a valve train 8 that drives the engine valve 3 to open/close. The valve train 8 pivots a camshaft 9 that is oriented in the front-rear direction with respect to the cylinder head 2 and is driven to rotate synchronously with the crankshaft. The camshaft 9 is provided with a drive cam 10 for driving the engine valve 3 to open/close. The drive cam 10 includes a base disc 11 having a shape, which does not lift the engine valve 3, and a lifting section 12 protruding from the base disc 11 that has a shape to lift the engine valve 3. The drive cam 10 is fixed to the camshaft 9 and is located backward in the front-rear direction with respect to the tappet 6 of the engine valve 3 as shown in FIG. 1(B).

Figure 3A:
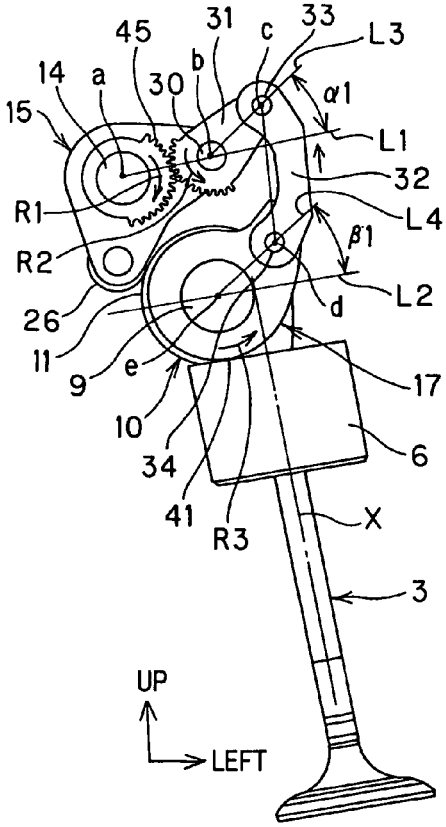
FIG. 3(A) is a front view of the variable valve activation system before lifting the valve in low-lift mode.
Figure 3B:
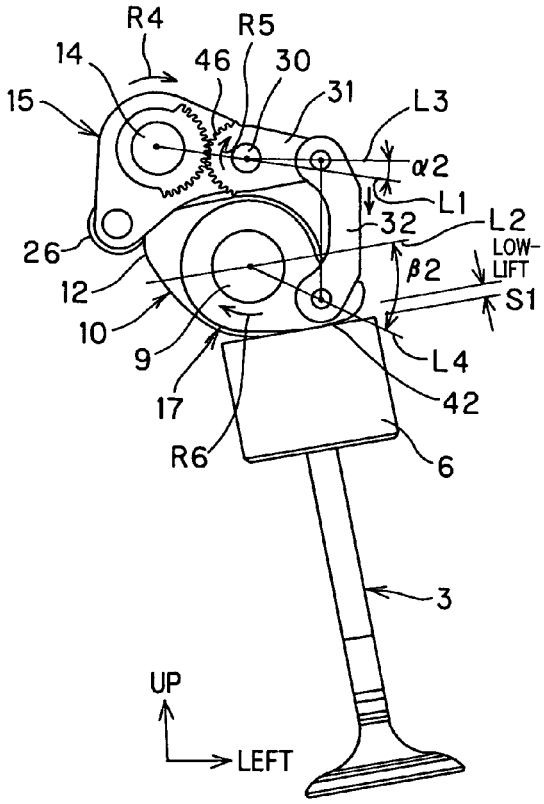
FIG. 3(B) is a front view of the variable valve activation system when the valve is lifted in low-lift mode.

The internal combustion engine 1 is provided with a variable valve activation system 13 that continuously varies lift amount of the engine valve 3. As shown in FIGS. 3(A) and 3(B), the variable valve activation system 13 is pivotally attached to a swing shaft 14, which is parallel to the camshaft 9, so as to swing thereon. The variable valve activation system 13 comprises a first arm 15, a swing cam 17 and a variable mechanism 18 as labeled in FIG. 1(A). The first arm 15 is driven to swing by the drive cam 10 attached to the camshaft 9. The swing cam 17 is linked with the first arm 15 by being interposed by a link mechanism 16 shown in FIG. 2 that is driven to swing by the first arm 15 to open/close the engine valve 3. The variable mechanism 18 varies the swing position of the swing cam 17 with respect to the engine valve 3.

The swing shaft 14 is positioned at the right side above the camshaft 9 parallel to the camshaft 9 and is rotatably pivoted by the cylinder head 2. An actuator 47 shown in FIG. 2 drives the swing shaft 14 to rotate the same to change the lift amount of the engine valve 3.

As shown in FIGS. 1(A), 1(B) and 2, first arm 15 includes a cam-arm portion 19 and a valve-arm portion 20. The cam-arm portion 19 extends downward from an area where the swing shaft 14 is located at the right side of the camshaft 9. The valve-arm portion 20 extends leftward from an area where the swing shaft 14 is located and over the camshaft 9. The cam-arm portion 19 and valve-arm portion 20 are integrated in a curved portion 21 located in a central portion of the first arm 15 to form a generally L-like shape. The first arm 15 is formed with a swing shaft hole 22 shown in FIG. 1(B), which goes through the curved portion 21 in the front-rear direction, and is formed with a boss 23, which extends in a direction of the swing shaft hole 22 at the rear side of the first arm 15. As shown in FIG. 1(B), the first arm 15 is located in front of the drive cam 10. By penetrating the swing shaft 14 backward through the swing shaft hole 22, the boss 23 pivots the swing shaft 14 so that the first arm 15 swings.

The first arm 15 is formed with a swing shaft-fixing hole 24 shown in FIG. 2 that is oriented backward in a lower portion of the cam-arm portion 19. A roller shaft 25 penetrates backward through the swing shaft-fixing hole 24 and is fixed thereto. The roller shaft 25 rotatably pivots a roller 26 that is brought into contact with the drive cam 10. The first arm 15 is also formed with a connection-pin fixing hole 27 oriented forward in a front area of the valve-arm portion 20.

The first arm 15 is formed with an engagement concave 28 or concave depression as shown in FIG. 2 at the right side thereof facing the cylinder head 2 in a lower area of the cam-arm portion 19. The first arm 15 is provided with a return spring 29 disposed between the cylinder head 2 and the engagement concave 28 to apply a force to the roller 26 in a direction to press the roller 26 against the drive cam 10. With this arrangement, the first arm 15 is pressed onto the base disc 11 and the lifting section 12 of the drive cam 10 provided to the camshaft 9 is driven to swing by the drive cam 10.

The link mechanism 16 shown in FIG. 2 includes a link pin 30, a second arm 31, a rod 32, a first link pin 33 and a second link pin 34.

The link pin 30 is fixed to the connection-pin fixing hole 27, which is formed at the front side of the valve-arm portion 20 of the first arm 15, and protrudes forward. The second arm 31 is rotatably attached to the link pin 30.

The second arm 31 is formed with a link pin through hole 35 at one end thereof and a first connection-pin fixing hole 36 in the other end thereof. As shown in FIG. 3(A), the second arm 31 is located in front of the first arm 15 on an extension of the axis X of the engine valve 3 and is disposed so as to extend leftward at the first connection-pin fixing hole 36 side. The link pin 30 fixed to the first arm 15 is inserted though the link pin through hole 35 so as to be rotatably connected with the first arm 15.

The rod 32 is provided with a pair of first connection portions 37 formed facing each other at one end thereof, and a pair of second connection portions 38 formed facing each other at the other end thereof. Each of the pair of first connection portions 37 is formed with a first link pin through hole 39. Each of the pair of second connection portions 38 is formed with a second link pin through hole 40.

In a state that the other end of the second arm 31 is sandwiched by the pair of first connection portions 37, the first link pin 33 is inserted through the first link pin through hole 39 to fix the same to the first connection-pin fixing hole 36. Thus, the one end of the rod 32 is rotatably linked with the other end of the second arm 31. Also, the rod 32 is disposed with the other end thereof faced downward toward the tappet 6 located therebelow, and is rotatably linked with the swing cam 17 by the second link pin 34.

Thus, the link mechanism 16 is rotatably linked with the first arm 15 by the link pin 30, and is provided with the second arm 31 that transmits the movement of the first arm 15 to the swing cam 17 by the rod 32 interposed therebetween.

The swing cam 17 includes a base disc 41 and a lifting section 42. The base disc 41 is shaped to come in contact with the tappet 6 and slide thereon but not to lift the engine valve 3. The lifting section 42 is shaped being protruded leftward of the vehicle from the base disc 41 so as to come in contact with the tappet 6 and slide thereon to lift the engine valve 3. The base disc 41 is formed with a camshaft through hole 43. The lifting section 42 is formed with a second connection-pin fixing hole 44. As shown in FIG. 1(B), the swing cam 17 is located in front of the drive cam 10 and on an extension of the axis X of the engine valve 3. The camshaft 9 is inserted through the camshaft through hole 43 to thereby pivot the swing cam 17 so as to swing on the camshaft 9.

The swing cam 17 is fixed to the second connection-pin fixing hole 44 in a manner that, in a state that the pair of the second connection portions 38 are positioned so as to sandwich the front end of the lifting section 42 of the rod 32, the second link pin 34 is inserted through the second link pin through hole 40. Thus, the lifting section 42 is rotatably connected to the other end of the rod 32.

With this arrangement, the swing cam 17 is linked with the first arm 15 by the link mechanism 16 so as to be driven to swing by the first arm 15 being interposed by the link mechanism 16 to open/close the engine valve 3.

The variable mechanism 18 includes a first gear 45 and a second gear 46. The first gear 45 is formed concentrically with the swing shaft 14 of the first arm 15. The second gear 46 is attached to the second arm 31 concentrically with the link pin 30 so as to engage with the first gear 45. The first gear 45 is provided integrally with the swing shaft 14 at the front side of the first arm 15 so as to face toward one end of the second arm 32 formed with the link pin through hole 35. The second gear 46 is integrally formed with one end of the second arm 31 so as to face toward the first gear 45.

The swing shaft 14 provided with the first gear 45 is connected to an actuator 47 like a motor. The actuator 47 is connected to a control unit 48. The control unit 48 is connected to a detection unit 49 that detects the operation status of the internal combustion engine 1. The control unit 48 receives signals indicating the operation status of the internal combustion engine 1 from the detection unit 49 and actuates the actuator 47 based thereon to rotate the swing shaft 14, and accordingly the first gear 45.

The variable mechanism 18 is arranged to cause the second arm 31 to swing through the rotation of the first gear 45 to thereby vary the swing position of the swing cam 17 with respect to the engine valve 3. Also, the variable mechanism 18 is arranged to cause the first arm 15 to swing in a state wherein the first gear 45 is held still to thereby cause the second arm 31 to swing in the same swing direction as that of the first arm 15.

The variable mechanism 18 is constituted of the first gear 45 and the second gear 46 being engaged with each other, through which the swing cam 17 is caused to vary the swing position thereof. Thereby the engine valve 3 is continuously controlled by varying the lift amount with the variable mechanism 18.

Lifting operation of the engine valve 3 by the variable valve activation system 13 is described below with reference to FIG. 3(A), FIG. 3(B), FIG. 4(A) and FIG. 4(B).

In the following description referring to FIGS. 3(A) through 4(B), the axis of the swing shaft 14 is defined as "a", the axis of the link pin 30 as "b", the axis of the first link pin 33 is defined as "c", the axis of the second link pin 34 is defined as "d", and the axis of the camshaft 9 is defined as "e". Further, a segment, which goes through the axis "a" and the axis "b" and orthogonal to these axes "a" and "b" is defined as "L1"; a segment, which goes through the axis "e" and orthogonal to the axis "X" of the engine valve 3, is defined as "L2"; a segment, which goes through axis "b" and the axis "c" and orthogonal to these axes "b" and "c", is defined as "L3"; and a segment, which goes through the axis "e" and the segment "d" and orthogonal to these axes "e" and "d", is defined as "L4". Furthermore, an angle, which is formed by the segment L3 with respect to the segment L1, is defined as "α", and an angle, which is formed by the segment L4 with respect to the segment L2, is defined as "β".

When low-lifting the engine valve 3, the variable valve activation system 13 operates as shown in FIG. 3(A) and FIG. 3(B). As shown in FIG. 3(A), in the variable valve activation system 13 in a phase before lift operation in which the base disc 11 of the drive cam 10 presses the roller 26 of the first arm 15, the actuator 47 rotates the swing shaft 14 in a direction of arrow R1. At this time, the second gear 46, which is engaged with the rotating first gear 45 of the variable mechanism 18, is rotated in a direction of arrow R2, and the second arm 31 is rotated in the same direction to an angle α1. The rotation of the second arm 31 up to angle α1 is transmitted to the swing cam 17 being interposed by the rod 32 to rotate the swing cam 17 in a direction of arrow R3 up to an angle 1.

In a state that the swing cam 17 is rotated up to the angle 1, the variable valve activation system 13 brings the swing shaft 14 to a halt and a part of the base disc 41, which is away from the lifting section 42 of the swing cam 17, is brought into contact with the tappet 6 and slide thereon to bring the engine valve 3 into a closed state as shown in FIG. 3(A).

In the variable valve activation system 13, from the closed state before lifting operation shown in FIG. 3(A), the camshaft 9 rotates and the lifting section 12 of the drive cam 10 presses the roller 26 to rotate the first arm 15 in a direction of arrow R4 as shown in FIG. 3(B). At this time, the second gear 46 engaged with the first gear 45, which is not rotating due to the halt of the swing shaft 14, rotates in a direction of an arrow R5 and the second arm 31 is rotated in the same direction up to an angle α2. The rotation of the second arm 31 up to the angle α2 is transmitted to the swing cam 17 being interposed by the rod 32, and the swing cam 17 is rotated in a direction of arrow R6 up to an angle β2.

With this rotation, the variable valve activation system 13 presses the tappet 6 with the base end of the lifting section 42 of the swing cam 17 to lift up the engine valve 3, and the engine valve 3 is brought into an open state of low-lift amount S1.

Figure 4A:
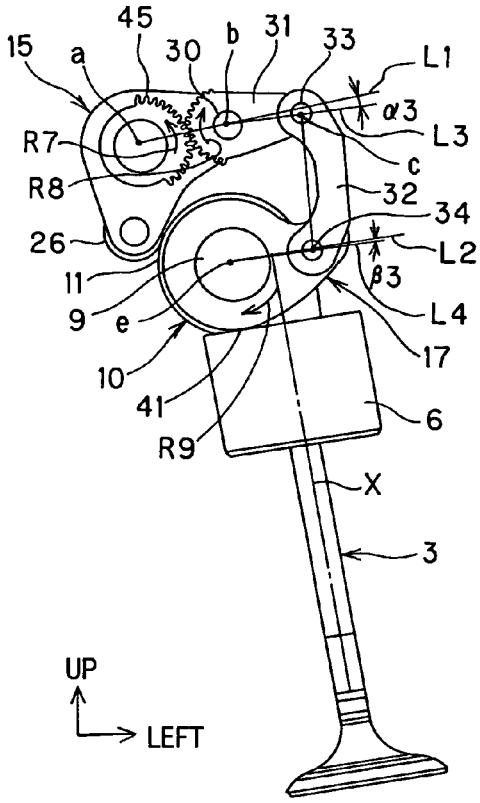
FIG. 4(A) is a front view of the variable valve activation system before lifting the valve in high-lift mode.
Figure 4B:
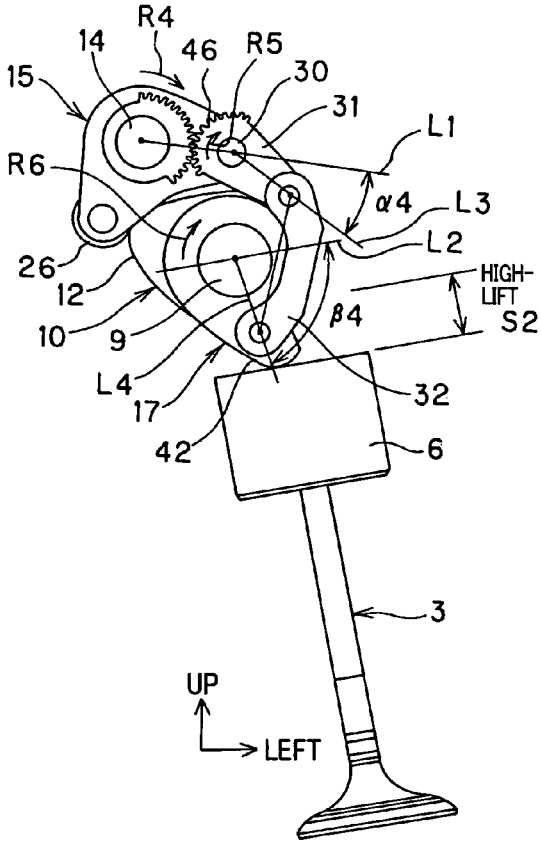
FIG. 4(B) is a front view of the variable valve activation system when the valve is lifted in high-lift mode.

When high-lifting the engine valve 3, the variable valve activation system 13 operates as shown in FIG. 4(A) and FIG. 4(B). In the variable valve activation system 13 in a phase before lifting the engine valve 3 in which the base disc 11 of the drive cam 10 presses the roller 26 of the first arm 15 as shown in FIG. 4(A), the actuator 47 causes the swing shaft 14 to rotate in a direction of an arrow R7 and the second gear 46 engaged with the rotating first gear 45 is rotated in a direction of an arrow R8 to rotate the second arm 31 in the same direction up to an angle α3. The rotation of the second arm 3 up to the angle α3 is transmitted to the swing cam 17 being interposed by the rod 32 to thereby rotate the swing cam 17 in a direction of an arrow R9 up to an angle β3.

In a state the swing cam 17 is rotated up to the angle 3, the variable valve activation system 13 brings the rotation of the swing shaft 14 to a halt, the part of the base disc 41 closer to the lifting section 42 of the swing cam 17 is brought into contact with the tappet 6 and slides thereon to thereby bring the engine valve 3 into a closed state shown in FIG. 4(A).

In the variable valve activation system 13 in a closed state before the lift operation shown in FIG. 4(A), the camshaft 9 rotates and the lifting section 12 of the drive cam 10 presses the roller 26 to rotate the first arm 15 in a direction of an arrow R4 as shown in FIG. 4(B). At this time, the second gear 46 engaged with the first gear 45, which is at a halt due to the halt of the swing shaft 14, rotates in a direction of an arrow R5 to cause the second arm 31 to rotate in the same direction up to an angle α4. The rotation of the second arm 31 in a direction of the angle α4 is transmitted to the swing cam 17 through the interposed rod 31; and thereby, the swing cam 17 is rotated in a direction of an arrow R6 up to an angle β4.

Due to the rotation, in the variable valve activation system 13, the front end of the lifting section 42 of the swing cam 17 presses the tappet 6 so that the engine valve 3 is lifted and brought into an open state of high-lift amount S2.

In the variable valve activation system 13 mounted on the internal combustion engine 1, when a pressing force is input from the drive cam 10 to the roller 26 attached to the first arm 15, the first arm 15 is driven to swing on the swing shaft 14 being interposed by the roller 26. The second arm 31 is pivoted on the first arm 15 by means of the link pin 30, and is disposed so that the second gear 46 engages with the first gear 45 provided to the swing shaft 14. When holding the lift timing and the lift amount at a constant level, the swing shaft 14 does not rotate.

The second arm 31 rotates on the swing shaft 14 along with the first arm 15. Since the second gear 46 is engaged with the first gear 45 of the swing shaft 14, the second gear 46 further rotates on the link pin 30 of the first arm 15. The rotation angle α of the second arm 31 depends on the gear ratio between the first gear 45 and the second gear 46.

With this arrangement, the variable valve activation system 13 causes the swing cam 17 to swing on the camshaft 9 being interposed by the rod 32 to open the engine valve 3.

When varying the operation angle and the lift amount of the engine valve 3, the actuator 47 acts like a motor to drive the swing shaft 14 to rotate, and through the first and second gears 45, 46 engaged with each other, the second arm 31 is rotated, and the rod 32 causes the swing cam 17 to swing. Thus the phase of the swing cam 17 with respect to the drive cam 10 is changed.

As described above, the variable valve activation system 13 on the internal combustion engine 1 has a structure such that the rotation of the first gear 45 is transmitted to the swing cam 17 through the interposed second arm 31 to vary the swing position of the swing cam 17. Thereby the lift amount S of the engine valve 3 is varied. Therefore, compared to the conventional structure in which an eccentric shaft shifts the swing fulcrum of the first arm to thereby vary the lift amount of the engine valve, a space necessary for shifting parts around the swing fulcrum (swing shaft 14) of the first arm 15 can be reduced.

Further, the variable valve activation system 13 of the internal combustion engine 1 has a structure such that, in a state that the first gear 45 is held in a halt (stopped position), by causing the first arm 15 to swing, the second arm 31 is caused to swing in the same swing direction as the first arm 15. Therefore, when the lift amount S of the engine valve 3 is the same amount as that of a conventional variable valve activation system, the drive cam 10 and the first arm 15 can be downsized.

With this arrangement, the variable valve activation system 13 of the internal combustion engine 1 is downsized. Thus the mounting performance and compact arrangement of variable valve activation system 13 on the internal combustion engine 1 is increased.

Furthermore, the variable valve activation system 13 of the internal combustion engine 1 can change the lift amount S of the engine valve 3 by changing the gear ratio between the first gear 45 and the second gear 46. Therefore, the variable valve activation system 13 increases the mounting performance on an internal combustion engine having a different lift amount S for the engine valve 3.

Figure 5A:
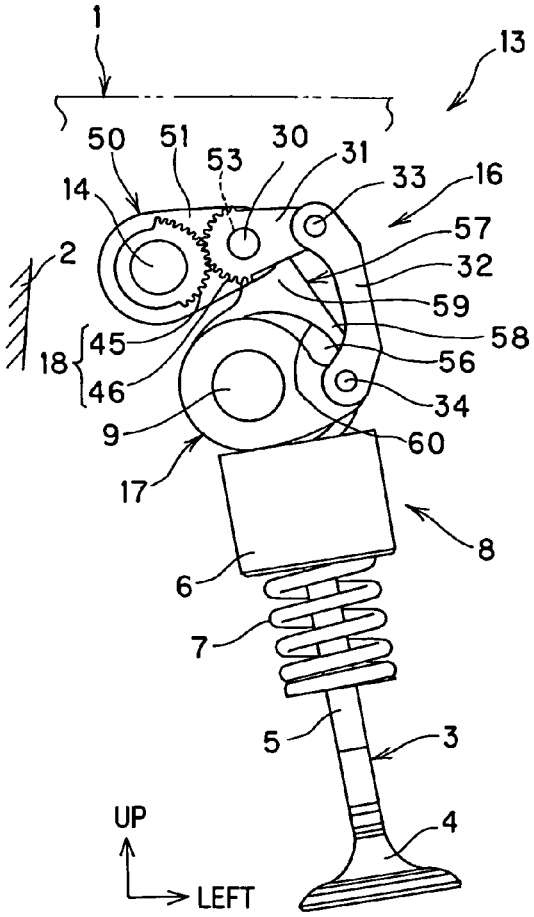
FIG. 5(A) is a front view of a variable valve activation system according to another embodiment of the invention.
Figure 5B:
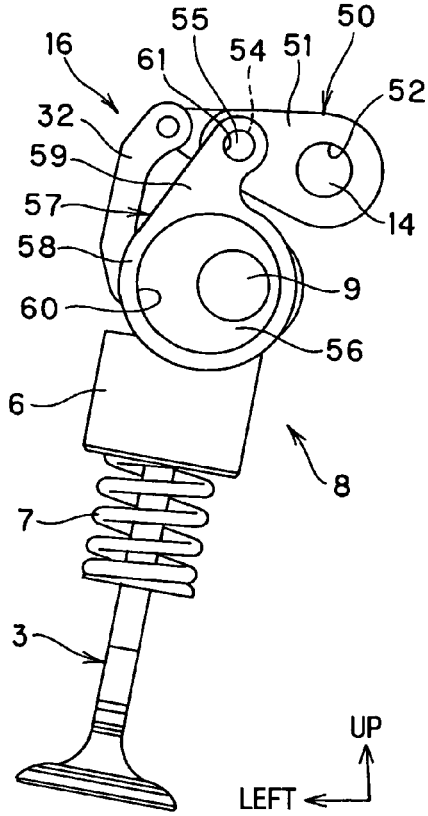
FIG. 5(B) is a rear view of the variable valve activation system of FIG. 5(A)
Figure 6A:
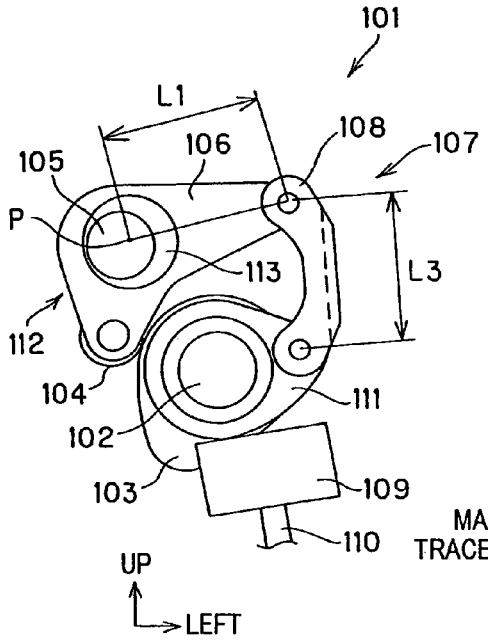
FIG.6A (PRIOR ART)
FIG. 6(A) is a front view of a conventional variable valve activation system before lifting the valve.
Figure 6B:
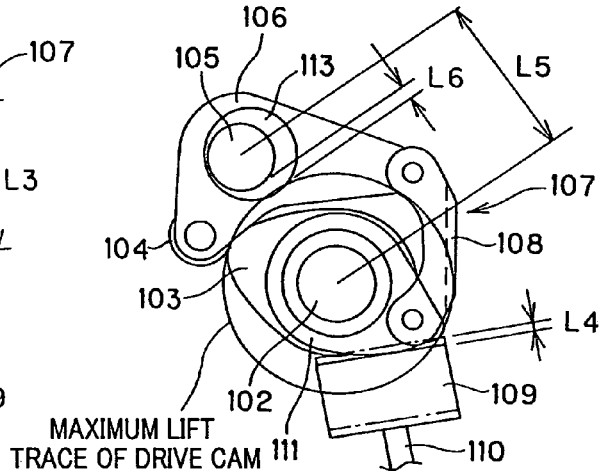
FIG.6B (PRIOR ART)
FIG. 6(B) is a front view of the variable valve activation system of FIG. 6(A) after the valve is lifted.
Figure 7A:
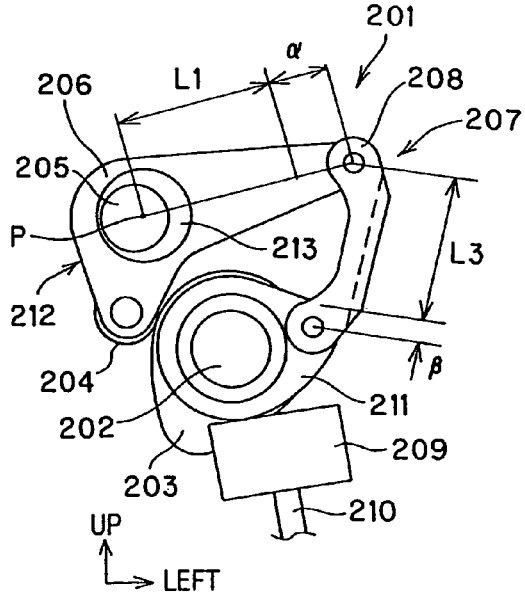
FIG.7A (PRIOR ART)
FIG. 7(A) is a front view of another conventional variable valve activation system before lifting of the valve.
Figure 7B:
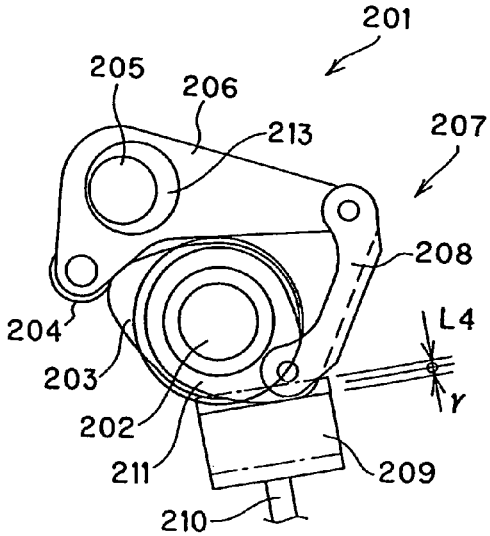
FIG.7B (PRIOR ART)
FIG. 7(B) is a front view of the conventional variable valve activation system of FIG. 7(A) after lifting of the valve.

FIG. 5(A) and FIG. 5(B) illustrate another embodiment of the invention. In the following description referring to FIG. 5(A) and FIG. 5(B), the parts that perform the same function as those in the first embodiment are given with the same reference numerals. In the variable valve activation system 13 according to the second embodiment, a first arm 50 is pivoted to the swing shaft 14 that is parallel to the camshaft 9 so as to swing thereon. Different from the above-described first arm 15, the first arm 50 is not provided with the cam-arm portion 19. Only a valve-arm portion 51, which extends from the swing shaft 14 leftward above the camshaft 9, is provided.

The first arm 50 is formed with a swing shaft through hole 52, a connection-pin fixing hole 53 and a rod connection pin fixing hole 54. The swing shaft through hole 52 goes through the valve-arm portion 51 in a front-rear direction in the base end portion thereof. The connection-pin fixing hole 53 is formed at the front end of the valve-arm portion 51 being oriented in a front-rear direction. The rod connection-pin fixing hole 54 is formed in the front-end portion of the valve-arm portion 51 being oriented backward. The connection-pin fixing hole 53 and the rod-connection pin fixing hole 54 are formed so that the respective axes are close to each other. The first arm 50 is provided with the link pin 30 and a rod-connection pin 55. The link pin 30 is fixed in the connection-pin fixing hole 53 located at the front side of the first arm 50 and protrudes forward. The rod-connection pin 55 is fixed in the rod-connection pin fixing hole 54 located at the rear side of the first arm 50 and protrudes backward.

In the variable valve activation system 13, the camshaft 9 constitutes the valve train 8 for driving the engine valve 3 to open/close. The camshaft 9 is provided with a disk-like drive cam 56 attached eccentrically thereon and on the drive cam 56, and a connection rod 57 is pivoted rotatably. The connection rod 57 includes a pivot portion 58 pivoted on the drive cam 56 and an extension portion 59 extending toward the first arm 50 from the pivot portion 58 and connected to the rear side of the first arm 50. The pivot portion 58 is formed with a drive cam pivot hole 60. The extension portion 59 is formed with a link pin through hole 61.

The drive cam 56 is engaged with the drive cam pivot hole 60 of the pivot portion 58 thereby the connection rod 57 is rotatably pivoted on the drive cam 56. The rod-connection pin 55 is inserted through the link pin through hole 61 in the extension portion 59; thereby the connection rod 57 is rotatably pivoted on the first arm 50.

The variable valve activation system 13 according to the second embodiment, same as in the first embodiment, employs the variable mechanism 18 constituted of the first gear 45 and the second gear 46. Thus the variable valve activation system 13 can be downsized resulting in an increased mounting performance and compact mounting arrangement for the variable valve activation system 13 when mounted onto the internal combustion engine 1. Further, by changing the gear ratio between the first gear 45 and the second gear 46, the lift amount S of the engine valve 3 can be changed. Thus, the mounting performance of the variable valve activation system 13 on an internal combustion engine having different lift amount S for the engine valve 3 can be increased.

Further, the variable valve activation system 13 is provided with the drive cam 56 eccentrically attached to the camshaft 9, and the drive cam 56 is linked with the first arm 50 being interposed by the connection rod 57 to thereby swing the first arm 50. Therefore, different from the first embodiment, the roller 26 and the return spring 29 for pressing the roller 26 onto the drive cam 10 are eliminated. Thus, the variable valve activation system 13 can be further downsized.

Further, in the variable valve activation system 13, since the connection-pin fixing hole 53 and the rod-connection pin fixing hole 54 are disposed close to each other in a peripheral direction of the first arm 50, the first arm 50 can be downsized. The connection pin fixing hole 53 and the rod-connection pin fixing hole 54 may be disposed on an identical axis. In this case, the link pin 30 and the rod-connection pin 55 may be formed integrally and may be fixedly engaged with the connection pin fixing hole 53 and the rod-connection pin fixing hole 54 which are in communication with each other. Therefore, in this modified arrangement the number of parts, working processes and assembly processes can be reduced.

The variable valve activation system for internal combustion engines of the invention is capable of downsizing the variable valve activation system without reducing lift amount of the engine valve; and thereby increasing the mounting performance and compact arrangement as mounted on an internal combustion engine. The variable valve activation system of the invention is applicable to internal combustion engines to be mounted with a variable valve activation system.

What is claimed is:

1. A variable valve activation system for internal combustion engines, comprising:

a first arm driven to swing by a drive cam provided to a camshaft;

a swing cam linked with the first arm being interposed by a link mechanism, the swing cam driven to swing by the first arm to thereby open/close an engine valve; and a variable mechanism for varying swing position of the swing cam with respect to the engine valve, and the variable mechanism continuously varying lift amount of the engine valve, wherein the first arm is rockably supported by a rocking shaft parallel to the camshaft, wherein the link mechanism includes a second arm, with a first end of the second arm being rotatably linked with the first arm by a connection pin and a second end of the second arm transmitting movement of the first arm to the swing cam through a link pin and a rod, wherein the variable mechanism includes a first gear provided concentrically with the rocking shaft of the first arm and a second gear provided with the second arm concentrically with the connection pin so as to mesh with the first gear, and wherein the variable valve activation system is arranged so that the rotation of the first gear causes the second arm to swing and vary the swing position of the swing cam with respect to the engine valve, while in a state wherein the first gear is in a stopped position and the engine valve is open, the first arm is caused to swing to thereby swing the second arm along an outer periphery of the first gear in a swing direction of the first arm about the connection pin.

2. A variable valve system comprising:

a first arm rocked by a driving cam disposed at a camshaft;

a rocking cam linked to said first arm through a link mechanism and rocked by said first arm to open and close an engine valve;

a variable mechanism for varying a rocking position of said rocking cam with respect to said engine valve; and a lift amount of said engine valve being sequentially varied by said variable mechanism, wherein said first arm is rockably supported by a rocking shaft which is disposed in parallel with said camshaft;

said link mechanism includes a second arm, a first end of said second arm being rotatably connected to said first arm through a connection pin and a second end of said second arm transmitting motion of said first arm to said rocking cam being linked to said rocking cam through a link pin and a rod;

said variable mechanism is composed of a first gear disposed coaxially with the rocking shaft of said first arm and a second gear disposed coaxially with said connection pin and in such a manner as to mesh with said first gear;

rotation of said first gear causes said second arm to rock so that the rocking position of said rocking cam is varied with respect to said engine valve, and when said engine valve is opened, said first arm is rocked with said first gear held in a standstill position, thereby rotating said second gear along an outer periphery of said first gear so that said second arm is rocked in a rocking direction of said first arm about said connection pin.

* * * * *